US005142717A

United States Patent [19]

Everard et al.

[11] Patent Number: 5,142,717

[45] Date of Patent: * Sep. 1, 1992

[54] CONSTANT PRESSURE LOAD BEARING AIR CHAMBER

[75] Inventors: Lloyd D. Everard, Kent, Wash.; Wilbur S. Wridge, Jr., Portland, Oreg.

[73] Assignee: Sustena, Inc., Kent, Wash.

[ * ] Notice: The portion of the term of this patent subsequent to Feb. 26, 2008 has been disclaimed.

[21] Appl. No.: 660,622

[22] Filed: Feb. 25, 1991

Related U.S. Application Data

[63] Continuation-in-part of Ser. No. 261,027, Oct. 20, 1988, Pat. No. 4,995,124.

[51] Int. Cl.[5] ..... A47C 27/08

[52] U.S. Cl. ..... 5/450; 5/453

[58] Field of Search ..... 5/449, 450, 453, 455

[56] References Cited

U.S. PATENT DOCUMENTS

| | | | |
|---|---|---|---|
| 1,218,291 | 3/1917 | Meinecke | 5/455 X |
| 1,271,472 | 7/1918 | Jakobson | 5/450 |
| 1,332,933 | 3/1920 | Sylvester | 5/450 |
| 2,751,610 | 6/1956 | Griswold | 5/453 |
| 3,042,941 | 7/1962 | Marcus | 5/450 |
| 3,822,425 | 7/1974 | Scales | 5/455 |
| 3,864,766 | 2/1975 | Prete | 5/450 |
| 3,879,776 | 4/1975 | Solen | 5/449 |
| 3,959,835 | 6/1976 | Nos | 5/455 |
| 4,428,087 | 1/1984 | Horn | 5/455 |
| 4,634,179 | 1/1987 | Hashimoto et al. | 297/DIG. 3 |
| 4,638,519 | 1/1987 | Hess | 5/455 |
| 4,655,505 | 4/1987 | Kashiwamura | 297/DIG. 3 |
| 4,662,012 | 5/1987 | Torbet | 5/455 |
| 4,694,515 | 9/1987 | Rogers | 5/449 |
| 4,694,520 | 9/1987 | Paul et al. | 5/449 X |
| 4,711,275 | 12/1987 | Ford et al. | 5/453 |
| 4,745,647 | 5/1988 | Goodwin | 5/455 X |
| 4,797,962 | 1/1989 | Goode | 5/455 X |
| 4,862,535 | 9/1989 | Roberts | 5/450 |

*Primary Examiner*—Renee S. Luebke
*Assistant Examiner*—Michael J. Milano
*Attorney, Agent, or Firm*—Christensen, O'Connor, Johnson & Kindness

[57] ABSTRACT

An air chamber including a control for manually selecting a desired pressure within the chamber. Means for sensing the air pressure within the chamber are provided as are pump means for adding air to the chamber and vent means for removing air from the chamber. Control circuitry adds or removes air from the chamber responsive to the sensed pressure to maintain the pressure within the chamber at the preset level. Structural means are provided within the chamber for supporting a portion of a load placed thereon and thus decreases air pressure within the chamber to avoid deflation.

14 Claims, 5 Drawing Sheets

CONSTANT PRESSURE LOAD BEARING AIR CHAMBER

RELATIONSHIP TO EARLIER APPLICATION

This application is a continuation-in-part to application Ser. No. 07/261,027 filed Oct. 20, 1988 now U.S. Pat. No. 4,995,124.

BACKGROUND OF THE INVENTION

1. Field of the Invention

The present invention relates broadly to air chambers adapted to support an external load and an apparatus for maintaining the air pressure within the chamber at a relatively constant preset level when the load is applied thereto. In particular, the invention relates to a constant pressure chamber suitable for use as an air mattress, seat cushion or other load bearing device.

2. Description of Prior Art

A long-standing problem in air mattress design involves the ability to maintain constant pressure within the air mattress in spite of varying loads on the mattress as one or more users sit or lie on the bed, toss and turn during sleep or arise and return to bed. The "feel" of the mattress to the user is directly related to the amount of air pressure within the mattress. Thus, in an air mattress into which air is drawn to a certain pressure and then sealed, such as those shown in U.S. Pat. Nos. 3,872,525 and 3,877,092, the internal pressure increases when a user lies thereon and the mattress thus "feels" harder as the load thereon increases.

U.S. Pat. Nos. 4,224,706 and 4,306,322 disclose air mattress systems which allow the firmness of the mattress to be controlled when a person is lying thereon through the use of a separate bladder which contains a quantity of air adapted to be transferred between the air mattress and the bladder responsive to changes in the volume of the bladder.

Also known are manually operated systems, such as that shown in U.S. Pat. No. 4,394,784, where air is supplied to a mattress by a blower or vented from the mattress through valves, both the blower and the valves being electronically controlled by hand-held control units. U.S. Pat. No. 4,078,842 discloses an inflatable auto seat wherein pressurized air is supplied by a manually operated compressor. U.S. Pat. No. 3,303,518 discloses an inflatable mattress wherein air is supplied to compartments therein by hoses connected to a remotely located compressor/pump controlled by the user.

U.S. Pat. No. 4,686,722 discloses a mattress formed from a plurality of individual cushions interconnected by ducting to an air pressure source. The pressure in selected cushions may be controlled by computer.

U.S. Pat. No. 4,694,520 discloses an air mattress which includes a sensor 170 positioned within the mattress which turns on an air compressor when the mattress deflates to a point where a patient comes in contact therewith.

U.S. Pat. No. 4,711,275 discloses a mattress including a rather complex system having a plurality of air compressors and pressure sensors to inflate and deflate portions of the mattress in cycle to prevent bedsores on a bedridden patient.

U.S. Pat. No. 4,679,264 discloses a self-regulating air mattress including a reservoir and means for adding or removing air from the system. A sensing device is disclosed which is adapted to sense the pressure in the mattress and add or remove air therefrom to maintain a constant pressure. Experimentation has shown, however, that such a system, supposedly designed to maintain pressure within a mattress at a predetermined level by sensing pressure and adding or removing air from the mattress in response to a change in pressure, simply does not work. The problem of such systems is that, assuming a preset pressure to be sensed and maintained, the pressure within the mattress is increased when a load is placed thereon. This increased pressure is sensed and air is vented from the mattress in response thereto. However, venting of air from the mattress does not decrease pressure within the mattress so long as the load remains thereon until the mattress is almost totally deflated.

The present invention provides an air mattress or the like which can be maintained at a constant pressure even under load without deflating.

SUMMARY OF THE INVENTION

It is known that pressure is generated in the air chambers of an air mattress by the force of the semi-elastic walls of the chambers upon the air captured therewithin. When a load, such as a person, is placed upon the mattress, the pressure within the mattress is produced both by the downward force exerted by the weight of the person and the forces generated by the semi-elastic mattress chamber walls. It has been found that if the size of the load placed on the mattress is relatively small, the increase in pressure normally caused by the load can be compensated for by the elasticity of the air chamber walls. As the load increases, however, the ability of the chamber walls to absorb the increasing pressure load diminishes and the air pressure within the chamber increases. As a result, the firmness of the mattress is also increased. In known active sensing mattress systems, the pressure sensor would, at this time, begin venting air from the mattress chambers to the atmosphere in an attempt to lower the pressure within the chambers. However, since the weight upon the mattress remains constant, and thus the pressure within the chambers remains at a constant high level, the venting of air to atmosphere does not reduce pressure but rather merely deflates the mattress.

In the present invention, applicants have solved this problem by providing a structure within the mattress chamber itself which is adapted to support a portion of a load placed upon the mattress to thereby reduce the air pressure within the mattress to a desired preset pressure level such that the sensor stops venting air to the atmosphere and the mattress does not deflate. In a preferred form, a resilient open-cell foam cushion is placed within the mattress which, while typically not resilient enough to constitute a comfortable mattress by itself, has the ability to support a sufficient amount of the weight of a person to allow the pressure within the mattress to be reduced. The reduced pressure is sensed and venting of air to the atmosphere is stopped. In practice, it has been found that due to the lightweight nature of the foam cushion, the "feel" of the air mattress does not change even when a person's body bears upon the foam through the upper surface of the mattress.

BRIEF DESCRIPTION OF THE DRAWINGS

The invention will be described more fully with reference to the preferred embodiment shown in the drawings wherein.

DETAILED DESCRIPTION OF THE INVENTION

Figure 1:
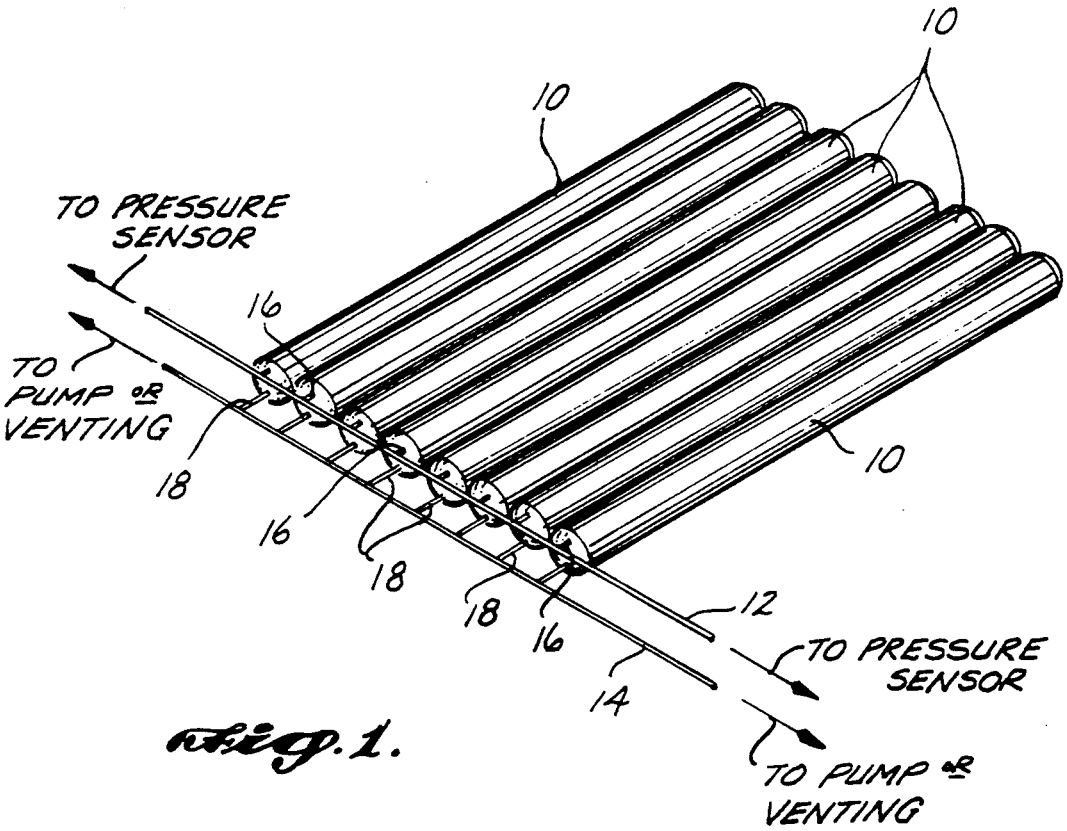
FIG. 1 is a schematic perspective view of a plurality of tubes suitable for use as the air support chambers of an air mattress, including conduit means interconnecting the tubes, connecting them to both a pressure sensor and pumping or venting means.

Referring initially to FIG. 1, a plurality of air chambers 10 are disclosed positioned side by side in the general form of a tube-shaped mattress core. In a preferred embodiment, the chambers are defined by membranes 11 formed of polyvinyl chloride in a known manner, although polyurethane or other suitable materials may also be used. In use as a mattress, the membranes 11 are typically covered on at least their top and bottom by a light foam pad 22 and the entire unit encased within a fabric cover 24 for sleeping comfort.

It has been found that in a preferred embodiment, the membrane 11 may be sized so that four membranes placed side by side define a single bed of so-called "twin bed" size, while eight membranes provide a satisfactory double bed.

As illustrated in FIG. 1, manifold means 12 interconnect all of the chambers 10 so that a uniform pressure is maintained in all of the chambers which, as indicated, may be sensed by a pressure sensor to which manifold 12 is connected. Likewise, manifold 14 interconnects all of the tubes and is in turn connected to air pump or air vent means in a manner which will be described in greater detail hereafter. Tubes 16 and 18 are shown connecting the individual chambers to the manifolds 12 and 14 respectively, but it will be understood that the particular shape of the tubes, manifolds, and the connections therebetween may be varied, and FIG. 1 is meant to be illustrative only.

In particular, it has been found that a double bed mattress is preferably provided with dual sensing, pumping and venting means so that persons lying side by side are able to separately control the air pressure within the chambers on their side of the mattress and the consequent firmness or "feel" of the mattress.

Figure 2A:
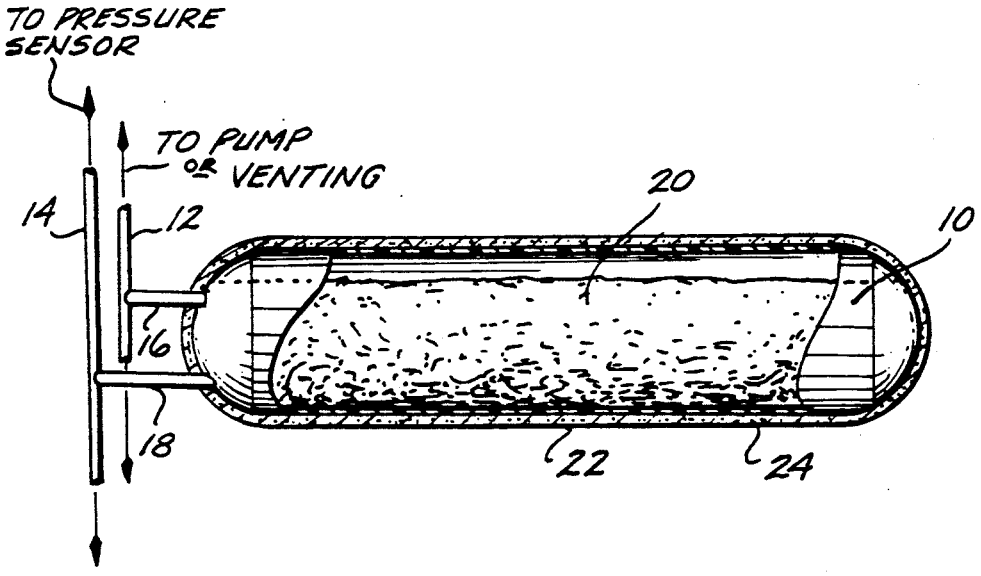
FIGS. 2a–2c are schematic side elevational views of the embodiments of the air chambers of FIG. 1 with portions of the sides broken away to show the positioning of the support elements therein.

Referring additionally to FIG. 2a, a support element 20 is shown positioned within the chamber 10 to act as load support in a manner to be described in greater detail hereafter. Element 20 is preferably formed of a lightweight, open cell foam and it will be understood that element 20 is positioned within chamber 10 during construction of the chamber and that the foam element may be of any suitable shape and may be affixed to or allowed to move loosely within chamber 10. The foam material 20 need not have a great crushing strength since the foam itself does not act as the major weight supporting element of the air mattress and, thus, in and of itself, need not be of a strength sufficient to be used as a satisfactory mattress. As depicted, the support element 20 is dimensioned so that the top of the support element is spaced away from the top portion of the inflatable membrane 11 when the membrane is fully inflated.

Figure 2B:
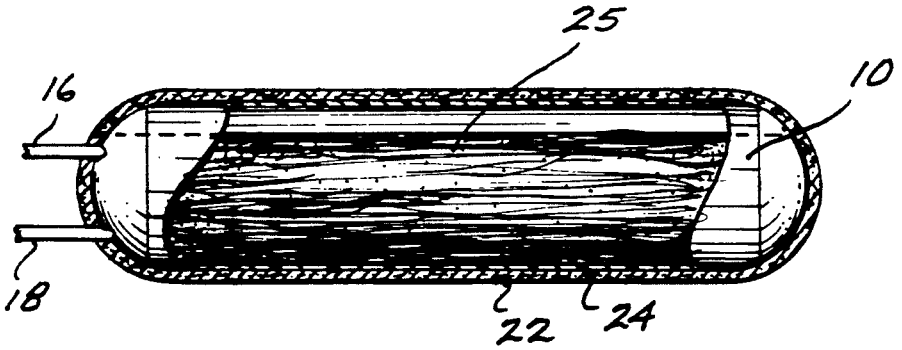
Figure 2C:
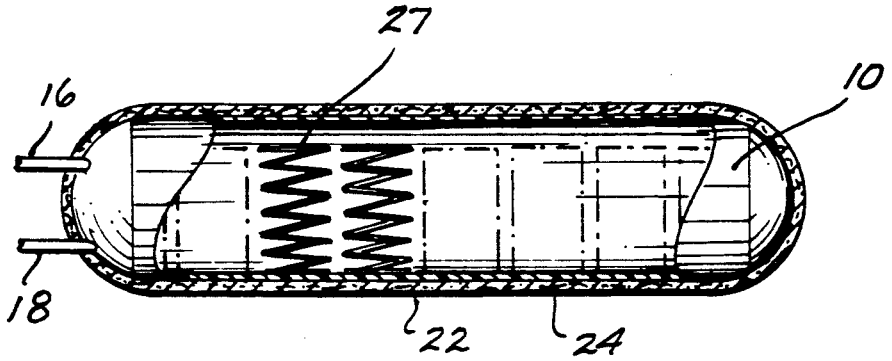

Besides the described foam material, a lightweight fibrous material or any other resilient material including a metal spring may be satisfactorily used to accomplish the function of supporting a portion of the user's weight to prevent total deflation of the mattress in the manner described hereafter. FIG. 2b depicts a version of the chamber 10′ wherein lightweight fibrous material 25 is provided as the fill material and FIG. 2c depicts a version of still another alternative embodiment of the invention wherein the metal springs 27 are disposed within the chamber 10″ to serve as the support element.

Figure 4:
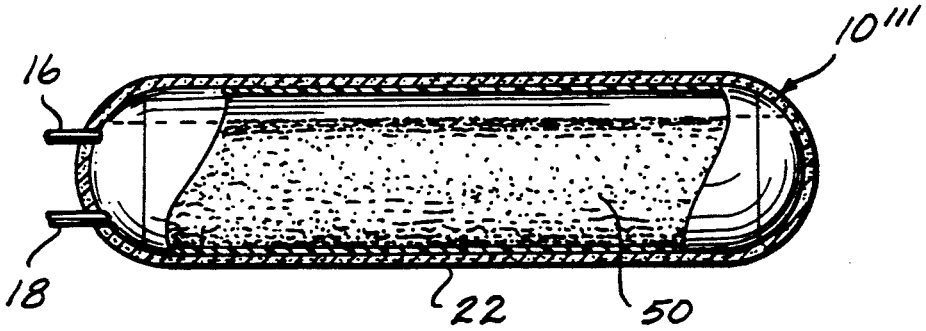
FIG. 4 is a schematic side elevational view of still another embodiment of the air chambers of FIG. 1 with the side portion broken away to show the supporting media therein.

While softness and resiliency are desired for comfort in a mattress, it will be understood that a nonresilient weight support means might be satisfactorily used to again accomplish the goal of decreasing air pressure to the extent necessary to cause the sensor to stop venting air to the atmosphere when a load is placed upon the inflated chamber. For example, as depicted in FIG. 4, a chamber 10‴ may be filled with small pellets 50 of resilient media that can support a load but that redistribute themselves when a load is placed on the chamber 10‴. The pellets 50 can be partially compressible material such as styrofoam balls. Alternatively, the pellets 50 can be formed out of incompressible material such as glass balls. The pellets 50 can be in any desirable shape, i.e., spheroid, ellipsoid, oblate spheroid or cylindrical with rounded ends. If the pellets 50 are sphere-shaped, it is anticipated that they would have a diameter between approximately 0.005 and 0.750 inches.

FIG. 2a also discloses the chamber covering foam pad 22 described above, as well as conventional fabric cover 24 surrounding and overlying the air chambers.

Figure 3:
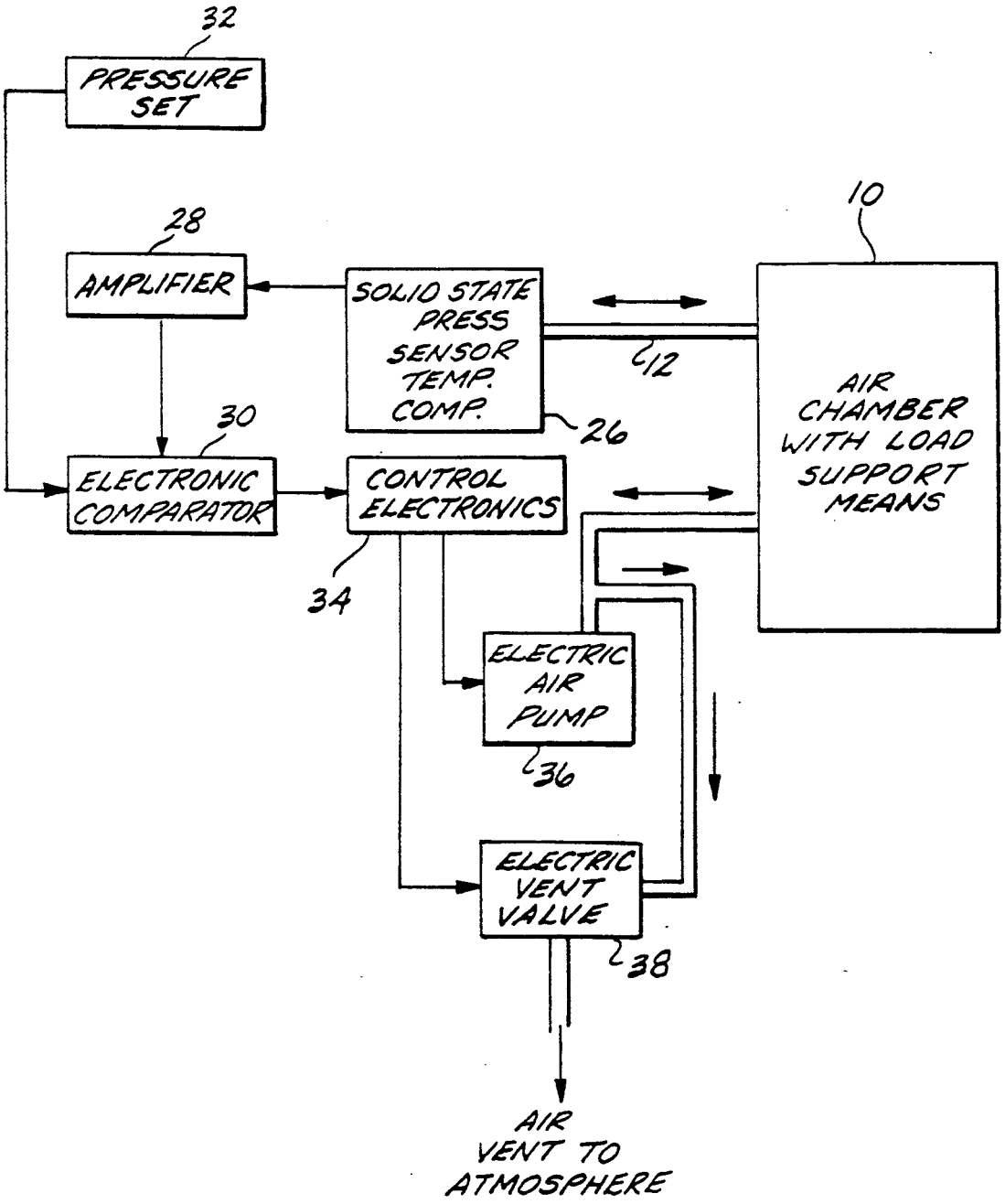
FIG. 3 is a block diagram illustrating the movement of air into and out of a chamber of the present invention, including the electronic controls therefor.

Referring now to the block diagram shown in FIG. 3, the operation of the present invention will be described in detail. As illustrated, chamber 10 is shown to be connected by means of conduit 12 to pressure sensor 26. In a preferred form, the pressure sensor is a conventional solid state device which is electronically compensated for changes in ambient air. It has been found that satisfactory pressures within chamber 10 range from between two inches to ten inches of gage water pressure, which is approximately one-thirtieth of atmospheric pressure. These small pressures place little stress upon the seams of the chamber 10, and thus the unit made according to the present invention has been found to be long-lived.

The output signal of pressure sensor 26 is led through a conventional amplifier means 28 to an electronic comparator 30 wherein the signal from the amplifier is compared to a signal generated by pressure select control 32. Elements 30 and 32 are conventional, off-the-shelf items, element 32 typically being of a type which allows a user to select the degree of mattress firmness, i.e., pressure within the air chamber, by simply turning a dial to an indicated setting. Air pressure within the chamber may be changed by simply turning the dial to a different setting. Electronic comparator 30 compares the selected pressure with the actual pressure within chamber 10 as transmitted through amplifier 28. Comparator 30 produces an output signal that is forwarded to control electronics 34 that controls an air pump 36 and a selectively open vent valve 38. The control electronics 34, in response to the comparator signal, either turns on electric air pump 36 or opens electric vent valve 38 to add or remove air from chamber 10. In a preferred embodiment, pump 36 is a diaphragm pump. Control electronics 34 are conventional as are air pump 36 and vent valve 38.

In typical operation, a user selects a desired air pressure within chamber 10 by adjusting the dial on the pressure select control 32. Assuming an initially deflated chamber, electric air pump 36 is activated to pump air into chamber 10 until pressure sensor 26 senses the pressure within the chamber is substantially equal to the desired selected pressure. If the air pressure within chamber 10 should increase or decrease due, for example, to a change in temperature or atmospheric pressure of the ambient air within the room where the mattress is placed, the change in pressure will be sensed and either air pump 36 turned on to force air into chamber 10 or vent valve 38 opened to bleed air from the chamber. In this manner the preselected pressure is maintained.

When a person lies upon the mattress, the pressure within chamber 10 is increased substantially. This increase in pressure is sensed by sensor 26, thus causing vent valve 38 to be opened to vent air from the chamber 10 in an attempt to decrease the pressure within the chamber. So long as the person remains on the mattress, however, simply bleeding air from the mattress will not decrease pressure within the chamber. In prior art mattresses, venting would be continued until such time as the mattress was nearly totally deflated and the user found himself in contact with the mattress support or floor. In the present invention, however, as air is vented to the atmosphere, the person comes in contact with the resilient means 20 within the air chamber 10 such that a portion of the user's weight begins to be supported thereby. Supporting of the user's weight, by the resilient foam, for example, causes a decrease in the air pressure within chamber 10 which is monitored by pressure sensor 26. When the decreased pressure equals the pressure previously selected by the user at pressure select control 32, control electronics 34 closes vent valve 38 so the mattress pressure is stabilized without total deflation. In practice, it has been found that the selection of a soft resilient foam for placement within chamber 10 allows a portion of the user's weight to be borne by the foam without the user experiencing any substantial change in the "feel" of the mattress.

Figure 5:
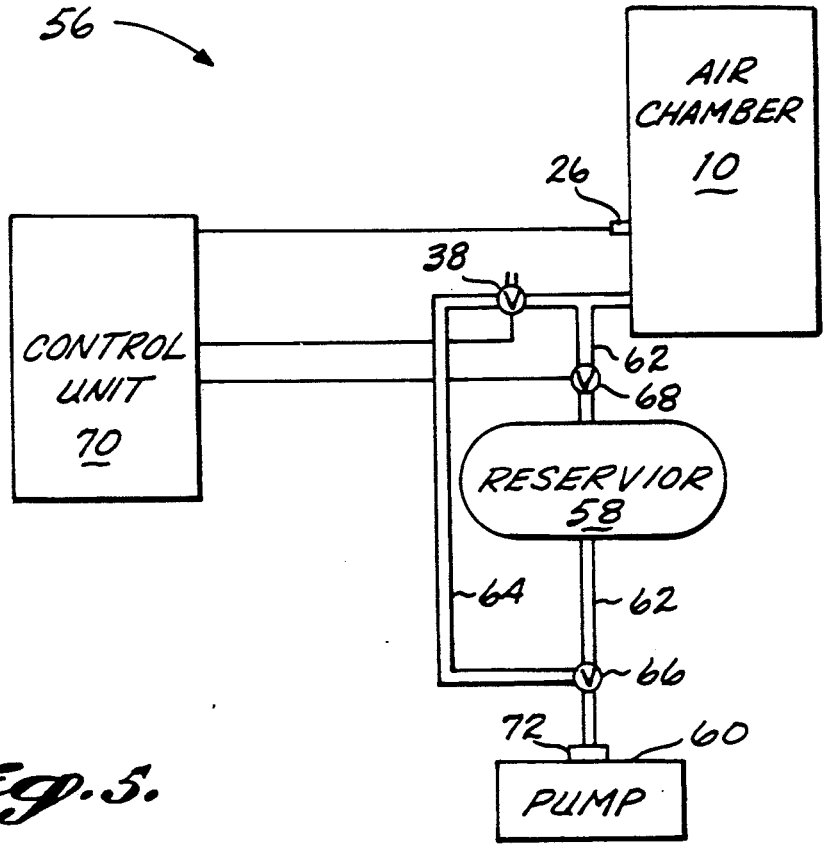
FIG. 5 is a block diagram illustrating the elements of an alternative embodiment of an air mattress of this invention.

FIG. 5 illustrates an alternative constant air pressure system 56 of this invention. System 56 includes a set of air chambers 10, one shown, a pressure sensor 26, and a vent valve 38 substantially identical to those previously disclosed in the previous embodiment. A reservoir 58 stores a quantity of air, which is pressurized to above the standard operating pressures of the air chambers 10, for repressurizing the air chambers. An electrically actuated air pump 60 pressurizes the reservoir 58 and initially inflates the air chambers 10. Separate sections of an air line 62 connect the pump 60 to the reservoir 58 and the reservoir to the air chambers 10. A branch line 64 connects the pump 60 directly to the air chambers 10. An electrically actuated valve 66 directs the output from the pump 60 to either the reservoir 58 or to the air chambers 10. An electrically actuated flow control valve 68 in the air line between the reservoir and the air chambers 10 controls the air flow to the air chambers from the reservoir 58. In the depicted embodiment of the invention, vent valve 38 is located in the branch line 62. In other embodiments of the invention, the vent valve 38 can alternatively be located in the air line between the air chambers 10 and the reservoir 58 or connected by a dedicated set of lines to the air chambers.

System 56 also includes a control unit 70 for actuating pump 60 and setting valves 38, 66 and 68. Control unit 70 is responsive to the pressure monitored by sensor 26 and contains the same basic amplifier 28, select control 32, comparator 30 and control electronics 34 described with respect to the first embodiment of the invention and illustrated in FIG. 3.

The reservoir 58 is any suitable air tank capable of holding anywhere between 1 and 10 liters of air at approximately 0.5 to 10 p.s.i. above atmospheric pressure. The reservoir 58 may for example, be in the form of a flexible bladder, not illustrated, that is contained with a shell or frame structure so as to limit the extent to which it can expand. Pump 60, in addition to being actuated by control unit 70, also includes a self-contained pressure actuated cut-off control 72. The cut-off control 72 automatically deactivates the pump 70 whenever the pressure in the reservoir 58 reaches a pre-selected maximum level. This eliminates the noise and power loss associated with endlessly running the pump and also prevents the possible blow out of the system due to the overpressurization of the reservoir 58. In some embodiments of the invention it is anticipated that the electrical line from the control unit 70 to the pump 60 will carry the power needed to energize the pump. In these embodiments of the invention, the control unit 70 will operate as a first level on-off control for the pump 60 by selectively energizing the pump.

When constant air pressure system 56 is initially activated, control unit 70 sets valves 38, 66 and 68 so that the output from pump 60 is supplied directly to the air chambers 10. After the air chambers 10 reach a selected pressure, control unit 70 resets valve 66 so that the pump 60 charges the reservoir 58. When the air chamber 10 pressure is set, the control unit 70 reads the output signals from pressure sensor 26 to determine the chamber pressure relative to the selected air pressure. If chamber 10 pressure is above the selected pressure, vent valve 38 is opened until the chamber pressure falls to the selected pressure as previously described. If chamber 10 pressure is below the selected air pressure, control unit 70 opens valve 68. The opening of valve 68 allows the air in reservoir 58, which is at a pressure higher than the chamber pressure, to flow into the air chambers 10. Once air chambers 10 reach the selected pressure level, control unit 70 closes valve 68. Then, each time the air chamber pressure falls below the selected pressure (as will happen when a person gets off a bed with which system is employed) the control unit 70 will again reopen valve 68 until the pressure returns to the selected level.

Figure 6:
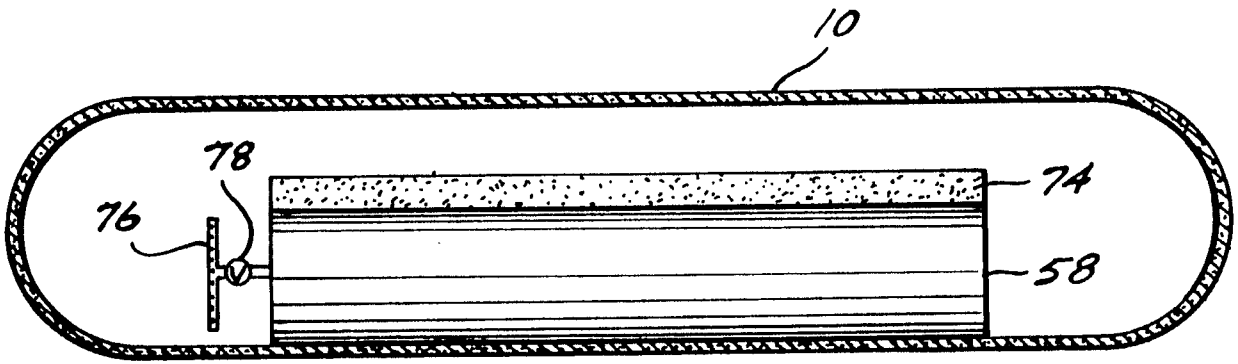
FIG. 6 is a schematic side elevational view of an air chamber that can be used with the alternative embodiment of the invention illustrated in FIG. 5.

FIG. 6 illustrates how the reservoir 58 of the system can be placed in an air chamber 10 so as to minimize the space occupied by the system. In this embodiment of the invention, reservoir 58 is in the form of a resilient rubber bladder or a plastic tank. A layer of foam padding 74 secured to the top of the reservoir 58 provides cushioning for persons resting on the air chamber 10 when it is deflated. In this embodiment of the invention, air from the reservoir 58 is vented into the remaining space of the chamber through a manifold 76 attached directly to the reservoir and disposed in the air chamber. A valve 78, in line with the manifold 76 and set by control unit 70, regulates the venting of air from the reservoir 58.

In this embodiment of the invention, it is understood that the air line 62, not illustrated, will be run directly from the pump 60 through the air cushion 10 into the reservoir 58. The branch line 64, not illustrated, is run from the pump 60 directly to the air cushion 10 so that the cushion can be initially pressurized when the system 56 is first activated. The vent valve 38, not illustrated, is connected to either the branch line 64 or is directly connected to the air cushion through a dedicated line.

When the pressure of the air chambers 10 of constant air pressure system 56 falls below a selected pressure level, the air in reservoir 58 rapidly fills the air chambers 10 so that the pressure returns to the selected level. This eliminates the need to provide a high powered, noisy pump in order to ensure that the air chambers 10 are always at the selected pressure. Moreover, since reservoir 58 has a relatively large quantity of air available for pressurizing the air chambers 10, the air hose 60 used to connect the reservoir to the air chambers can be relatively large in diameter, for example, between 0.75 and 1.75 inches. This further enhances the ability of the system 56 to rapidly repressurize the air cushions when the pressure falls below the selected level.

The foregoing detailed description has been limited to specific embodiments of the invention. It will be apparent, however, that variations and modifications can be made to this invention with the attainment of some or all of the advantages thereof. For example, it will be understood that tubes of a variety of shapes and configurations may be employed with individual pressure sensing and control means to create a mattress wherein portions of the surface may be separately controlled as to firmness. Such a mattress is particularly valuable for use in connection with patients suffering from burns, skin ulcers, or other conditions where it is helpful to support a portion of the patient's body on a mattress of reduced firmness.

Also, alternative control structures are possible with the attainment of some or all of the advantages of the claimed invention. For instance, there may be no need to interconnect pump 60 with control unit 70. In these versions of the invention the pump 60 will be directly connected to a power outlet and actuated by the cut-off control 72 and a pump-mounted on-off switch.

Furthermore, it is clear that alternative constructions may be used to connect the air chambers 10, reservoir 58, pump 60, and vent valve 38 together and still fall within the metes and bounds of this invention. For example, in some versions of the invention, it may not be necessary to provide a branch line from the pump directly to the air chambers. In these embodiments of the invention, the air cushion will always be filled directly from the reservoir 58, even when the air cushion is initially inflated. In still other embodiments of the invention, the branch line may be used to connect the pump directly to the air chambers and not be in fluid connection to the air line connected between the reservoir and the air chambers. Moreover, the reservoir 58 can clearly be placed in any desirable location, such as in a frame used to support the air cushions of this invention.

Therefore, it is the object of the appended claims to cover all such variations and modifications that come within the true spirit and scope of the invention.

The embodiments of the invention in which an exclusive property or privelege is claimed are defined as follows:

1. An air mattress capable of supporting a load comprising:

an inflatable membrane defining a chamber having a chamber air pressure;

load supporting material disposed in said chamber;

a reservoir containing a quantity of air and charged to a selected pressure in fluid communication with said chamber and having a valve associated therewith controlling airflow from said reservoir to said chamber;

a selectively openable vent valve in fluid communication with said chamber;

a pressure sensor in fluid communication with said chamber for generating a sensed pressure signal representative of said chamber air pressure;

a pressure selector generating a desired pressure signal representative of a desired chamber air pressure; and a control means connected to said reservoir valve and said vent valve and receiving said sensed pressure signal and said desired pressure signal for maintaining said chamber at approximately said desired chamber air pressure whereby when the load on said membrane causes said chamber air pressure to rise above said desired air pressure, said vent valve is opened until at least a portion of the load is supported by said load supporting material so that said chamber air pressure falls to approximately said desired air pressure and, whereby when said chamber air pressure falls below said desired air pressure, said reservoir valve is opened until said chamber air pressure rises to approximately said desired chamber air pressure.

2. The air mattress of claim 1, further including a pump in fluid communication with said reservoir for charging said reservoir.

3. The air mattress of claim 1, wherein said means within said chamber for supporting a portion of said load comprises an open-cell plastic foam.

4. The air mattress of claim 1, wherein said means within said chamber for supporting a portion of said load comprises a resilient fibrous material.

5. The air mattress of claim 1, wherein said means within said chamber for supporting a portion of said load comprises a metal spring means.

6. The air mattress of claim 1, wherein said means within said chamber for supporting a portion of said load comprises a plurality of pellets of resilient media.

7. The air mattress of claim 1, wherein said control means includes a comparator for receiving said sensed pressure signal and said desired pressure signal and, in response thereto, generating a comparator signal and a control circuit for receiving said comparator signals and in response thereto, controlling actuation of said reservoir valve and said vent valve.

8. The air mattress of claim 7, wherein said control circuit in response to a comparator signal indicating that chamber air pressure is below said desired chamber air pressure, opens said reservoir valve.

9. The air mattress of claim 2, further including a branch line connected between said pump and said inflatable membrane and a valve connected to said branch line for controlling air-flow therethrough wherein said valve is regulated by said control means.

10. The air mattress of claim 1, wherein said reservoir is disposed in said inflatable membrane and said reservoir functions as said load-supporting material.

11. The air mattress of claim 10, further including a layer of foam disposed on top of said reservoir.

12. The air mattress of claim 2, further including a pressure-actuated cutoff control for regulating activation of said pump wherein said cutoff control is connected between said pump and said reservoir.

13. The air mattress of claim 9, further including a pressure-actuated cutoff control for regulating activation of said pump wherein said cutoff control is connected between said pump and said reservoir.

14. An air mattress capable of supporting a load comprising:

an inflatable membrane defining a chamber having a chamber air pressure;

load supporting material in the form of a plurality of pellets formed of resilient material disposed in said chamber;

a selectively actuatable air pump in fluid communication with said chamber to supply pressurized air thereto;

a selectively openable vent valve in fluid communication with said chamber;

a pressure sensor in fluid communication with said chamber for generating a sensed pressure signal representative of said chamber air pressure;

a pressure selector generating a desired pressure signal representative of a desired chamber air pressure; and a control means connected to said air pump and said vent valve and receiving said sensed pressure signal and said desired pressure signal for maintaining said chamber at approximately said desired chamber air pressure whereby when the load on said membrane causes said chamber air pressure to rise above said desired air pressure, said vent valve is opened until at least a portion of the load is supported by said load supporting material so that said chamber air pressure falls to approximately said desired air pressure and, whereby when said chamber air pressure falls below said desired air pressure, said reservoir valve is opened until said chamber air pressure rises to approximately said desired chamber air pressure.

* * * * *